US005669073A

United States Patent [19]

Pellington

[11] Patent Number: 5,669,073

[45] Date of Patent: Sep. 23, 1997

[54] GOLF GLOVE WITH GRIP POSITIONING MEANS

[76] Inventor: Mark E. Pellington, 506 10th Ave. S., No. Myrtle Beach, S.C. 29582

[21] Appl. No.: 603,709

[22] Filed: Feb. 20, 1996

Related U.S. Application Data

[63] Continuation-in-part of Ser. No. 387,480, Feb. 13, 1995, abandoned.

[51] Int. Cl.[6] ..... A41D 19/00

[52] U.S. Cl. ..... 2/161.2; 2/160

[58] Field of Search ..... 2/159, 160, 161.1, 2/161.2, 161.3, 161.4, 162, 163; 273/187.2, 188 R

[56] References Cited

U.S. PATENT DOCUMENTS

| | | | |
|---|---|---|---|
| 1,681,389 | 8/1928 | Blake | 2/161.2 |
| 2,751,598 | 6/1956 | Romeo | 2/161.3 |
| 2,852,779 | 9/1958 | Roessler | 2/161.1 |
| 3,105,972 | 10/1963 | Christopher | 2/161.1 |
| 3,274,616 | 9/1966 | Russo | 2/161.3 |
| 3,348,238 | 10/1967 | Hydock | 2/161.1 |
| 3,368,811 | 2/1968 | Finney | 2/161.2 |
| 3,918,097 | 11/1975 | Mlodoch | 2/161.1 |
| 4,796,306 | 1/1989 | Mitchell | 2/160 |
| 5,022,094 | 6/1991 | Hames et al. | 2/161.1 |
| 5,033,120 | 7/1991 | Myers | 2/161.2 |

FOREIGN PATENT DOCUMENTS

| | | | |
|---|---|---|---|
| 0821653 | 8/1937 | France | 2/161.2 |
| 6079029 | 3/1994 | Japan | 2/161.2 |
| 1023779 | 3/1966 | United Kingdom | 2/161.3 |

*Primary Examiner*—Michael A. Neas
*Attorney, Agent, or Firm*—Michael E. Mauney

[57] ABSTRACT

An improved golf glove for assisting a golfer to grip the club properly, for placing the wrist in the maximum desirable un-cocked position as the ball is addressed, for promoting arm extension and for maximizing the chance of returning the club face to the proper position at impact. The improved golf glove includes an elastic strap attached to the palm side base of the glove at a slight angle approximately parallel to a line along the base of the middle finger, ring finger, and little finger of the glove. As the club is gripped, the elastic strap is stretched to attach to the back of the middle finger, ring finger, and little finger portions of the glove which positions the club in the hand along that base of the middle finger, ring finger, and little finger and ensures an even grip pressure throughout the swing.

10 Claims, 2 Drawing Sheets

GOLF GLOVE WITH GRIP POSITIONING MEANS

This application is a continuation-in-part of application Ser. No. 08/387,480, filed Feb. 13, 1995, now abandoned.

BACKGROUND OF THE INVENTION

The present invention relates to an improved golf glove used by a golfer for teaching the golfer to maintain proper grip pressure on the golf club by the middle finger, ring finger, and little finger of the glove hand, for promoting the club to be gripped in the proper orientation and position in the glove hand, for promoting the wrist to be in the maximum desirable un-cocked position when the ball is addressed, for promoting the maximum arm extension and locking of the elbow of the glove hand, and for maximizing the chance of returning the club face to the proper position at impact during the golf swing.

Various types of golf glove aids have been developed for assisting a golfer to grip the club. Generally, these types of golf gloves do not set the grip in the pressure fingers, that is the middle finger, ring finger, and little finger of the glove hand, and encourage a golfer to apply too much grip pressure adding unwanted muscle tension to the shoulder and arm that restricts their movement. An early technique taught by Blake U.S. Pat. No. 1,681,389 shows the use of a golf pad where a strap is used for assisting the golfer and holding the club. The French patent Tingey #821,653 shows a strap and buckle attached to the glove back area of a golf club and wrapped from behind fingers around the club handle and palm area to secure the club handle in the palm. The strap is directed just under the thumb and attached to the buckle. Christopher U.S. Pat. No. 3,105,972 discloses a golf club having an elastic band 16 secured conveniently by stitching 17 to the palm side and the base portion of the thumb stall 18 of the glove 10. The end portion of the band 16 is secured to the glove, is disposed at an inclination transversely to the palm and away from the wrist thereof. Hydock U.S. Pat. No. 3,348,238 also shows a glove having a tape 9, having an end 10, which is cut on the bias and sewn to the glove at the junction between the upper outer edges of the thumb sections 7 and 8. This section of "Velcro" hook tape extends diagonally across the palm of the glove and to a point approximately midway of the finger receiving pockets or stall. Mitchell U.S. Pat. No. 4,789,306 teaches elastic straps on each finger that attach to the palm side of the glove. The little finger strap is connected diagonally across the palm to the underside of the pad of the thumb.

The Blake, Tingey, Christopher, and Hydock prior art patents teach the concept of placing the grip diagonally in the palm of the glove hand. The glove hand is the left hand for the right-handed golfer and the right hand for the left-handed golfer. It is the lead hand in the golf swing. In these prior art patents, the grip handle is parallel to the diagonal life line of the palm, which was the teaching method of the time. The above described prior art patents use a strap that wraps diagonally around the fingers which leaves gaps between the pressure fingers, that is the middle finger, ring finger, and little finger, in the grip handle thus, locking the fingers in the diagonal position parallel to the life line of the palm. With the grip handle gripped at this diagonal orientation in the pressure fingers, the maximum desirable un-cocked position of the wrist never takes place and arm extension for the glove hand arm is not maximized. Because arm extension is not maximized, the joints at the elbow and shoulder are not activated, and regripping may still occur which causes unwanted tension in the muscles within the forearm, thus, reducing club head speed and directional control. The Mitchell prior art patent likewise promotes placement of the golf club in a diagonal position in the hand and promotes a grip primarily in the palm of the hand, leaving the wrist partially cocked, rather than achieving a maximum desirable un-cocked position. In the Mitchell patent, connecting the little finger strap to the thumb pad insures that the club is gripped diagonally in the palm. The use of a strap on the index finger involves the index finger in the grip. This may be an effective grip for a tennis racket or baseball bat, but is unsuitable for swinging a golf club.

A correct grip in the glove hand orients the club parallel to the base of the pressure fingers. If one attempts to grip the club so oriented and employing the prior art patents, the diagonal straps employed in the prior art gloves will result in uneven pressure for the pressure fingers on the golf club handle. This will cause a gap to form between the pressure fingers and the club handle during a swing, which leads to regripping of the club, which will often change the orientation of the club during the swing and lead to inconsistent results, such as off-center strikes of the ball on a club face or closing or opening of the club face leading respectively to hooking or slicing of the golf ball.

SUMMARY OF THE INVENTION

In view of the prior art above, it is the object of the present invention to provide a golf glove having an elastic band connected to the palm side at the base of the glove. The distal end of the elastic band will attach to the back of the pressure fingers when the pressure fingers are gripping the club. The proximal end of the elastic band is approximately parallel to the base of the pressure fingers and at a slight angle to the base of the glove, hence the base of the wrist. When the club is gripped properly, it is positioned in the hand approximately along the line of the base of the three pressure fingers, so that the club shaft is oriented at the same angle to the base of the wrist as is the line formed by the base of the fingers. The pressure fingers then fold across and grip the club. The elastic band is stretched and the distal end attached to the back of the three pressure fingers. The stretching of the elastic band creates equal gripping pressure on the three pressure fingers to hold the club in place because the club is parallel to the base of the pressure fingers, as is the proximal attachment of the elastic band. The elastic band stretches the same amount to each pressure finger attachment, hence applies even pressure to each of the three pressure fingers causing equal gripping pressure to be applied by the pressure fingers to the club handle. For people who are not accustomed to gripping the club in this fashion or who grip it with uneven pressure, the use of the present invention teaches these important principles to the golfer using the glove while teaching the golfer "muscle memory" about how a proper grip should feel. Once acquired this "muscle memory" will enable the golfer to properly grip the club even if the present invention is not employed during the swing.

When the club is gripped properly as described above either with or without the use of the present invention, then at the address position when the base of the club is grounded behind the ball, the wrist of the glove hand will be at or near to the maximum desirable un-cocked position. If one stands with one's arm extended parallel to the ground gripping a golf club along the base of the pressure fingers in the left hand (for right-handed golfers), then an un-cocked position is achieved when the head of the club is rotated toward the ground on the same plane as the arm and wrist so that the club is no longer in an approximately perpendicular position to the ground, but rather leans so that an acute angle is formed between a line parallel to the ground and the line of the club shaft. The maximum un-cocked position is achieved when the downward wrist flex is at its physiological limits. This downward flex of the wrist as it approaches its maximum naturally straightens the arm and locks the elbow. In a golf grip and swing, the maximum desirable un-cocked position is achieved by a natural, unforced downward flex of the wrist to the point the elbow of the glove hand locks and there is the beginning of some tension in the wrist. In the prior art grips, where the club is gripped parallel to the life line in the palm, if one stands with one's arm fully extended and gripping a club along the life line of the palm, then the club is already leaning at an acute angle even when the wrist is in a neutral position. However, when the club is gripped parallel to the base of the pressure fingers as is taught by the present invention, it is much more upright and nearly perpendicular to the ground when the wrist is in a neutral position. Therefore, when the club is gripped in the fashion of the present invention and the sole of the club is to be grounded behind the ball at address, it is necessary to flex the wrist downward from the neutral position, thus achieving an un-cocked position. For most golfers gripping the club parallel to the base of the pressure fingers will result in the maximum desirable un-cocked wrist position as the club is grounded. Thus, the present invention teaches a golfer how to grip the club so that the maximum desirable un-cocked position of the wrist normally results at address position. The present invention prevents a loosening of the pressure fingers at address. Loosening these fingers at address would let the club "flop" over to the ground at address even without the wrist assuming the maximum desirable un-cocked position. When the wrist is flexed downward as is taught by the present invention to achieve the maximum desirable un-cocked wrist position, then the un-cocking of the wrist naturally locks the elbow on the arm of the glove hand. For a right-handed golfer, this means that the left elbow is locked in a straight position. A locked left elbow gives maximum arm extension for a right-handed golfer, which promotes the widest swing arc, hence, the greatest possible club head speed.

It is a further object of the present invention not only to achieve a proper static grip in the address position as described above, but also to teach maintaining the proper grip in the dynamics of the golf swing. As the club is swung back and approaches the top of the swing arc, the head of the club goes past perpendicular and approaches a position parallel to the ground. The momentum of the club head causes the wrist to flex slightly upward in the direction of the club travel (called "cocking"). The momentum of the club head creates a force on the club handle which will exert pressure against the three pressure fingers and especially against the ring finger and little finger which can cause the grip to loosen. The elastic band keeps these fingers locked in the correct position and prevents the club being "loose" at the top of the swing. If the fingers loosen, then as the swing starts down the club must be regripped. Regripping the club introduces a variable that causes inconsistency in the position of the club at impact. The present invention teaches the golfer how it feels to maintain even grip pressure throughout the swing, thus not loosening the grip at the top of the back swing which requires the golfer to regrip the club.

As the golfer starts the down swing, the momentum and force exerted by the club head reverse themselves. The "centrifugal" force exerted by the club head naturally causes a relaxed wrist to go from the cocked position at the top of the back swing to an un-cocked position at the impact position. The un-cocking of the wrists and the rolling of the right or following wrist over the left or lead wrist (for right handed golfers) is termed "releasing the club." Because the present invention teaches the assumption of the maximum desirable Un-cocked position of the wrist as the club head is grounded behind the ball at address, then the momentum created by the club head naturally tends to return the club to this maximum desirable un-cocked position at impact. It requires no conscious manipulation by the golfer of his grip to return to the address position at impact. This desirable return to the address position at impact occurs naturally as a result of the swing process and is easily repeated.

Thus, by providing an elastic strap attached so that it is approximately aligned parallel with the base of the three pressure fingers, then the possibility of achieving the following outcomes is enhanced: the club is gripped parallel to the base of the three pressure fingers at address; the wrist is in the maximum desirable un-cocked position at address; the arm of the glove hand is fully extended and the elbow locked; as the club is swung back even pressure is maintained by the pressure fingers as assisted by the elastic positioning strap; there is no loosening of the grip at the top of the back swing, hence regripping of the club; and the momentum of the club head created in the down swing tends to return the wrist to the maximum desirable un-cocked position, hence return the club head to the same position it had at address, thus greatly enhancing the possibility of a repeating swing.

It is a further object of this invention to leave the forefinger and thumb uninvolved in the grip of the club by the glove hand. Most golfers use an overlapping or interlocking grip. In this grip, the forefinger is primarily involved in connecting the gloved hand to the ungloved hand, thus forming a unitary, single piece grip. A few golfers use an unorthodox baseball grip, where the hands are not connected by the use of the forefinger on the gloved hand and of the little finger on the ungloved hand. If one uses the forefinger and thumb of the glove hand to grip the club, then this grip involves the larger muscles on the top of the forearm that control the thumb and forefinger as opposed to the smaller muscles on the underside of the arm which control the middle, ring, and little fingers or pressure fingers. Involving the larger muscles which control the thumb and forefinger in the grip results in a tightening of the wrist and reduction of the motion of the wrist in the swing. The wrist must freely cock in the back swing and uncock in the down swing to achieve maximum club head speed as the club is "released". It also means the golfer must manipulate the club head back to the address position during the swing by use of muscle control, rather than by allowing the momentum generated by the swing to naturally return the club head to the address position at impact. The present invention allows the club to be securely and consistently gripped by the pressure fingers of the glove hand, thus reducing the temptation or need on the part of the golfer to involve his index finger and his thumb, hence larger arm muscles, in the grip of the club by the glove hand. The present invention teaches a natural grip easily maintained throughout the swing which uses the momentum and force created during the swing to increase the likelihood of returning the club to the address position at the point of impact of the club with the ball.

BRIEF DESCRIPTIONS OF THE DRAWINGS

In the accompanying drawings forming a part of this specification, and in which like numerals are employed to designate like parts throughout the same, FIG. 1 is a front view of a prior art;

DESCRIPTION OF PREFERRED EMBODIMENTS OF THE INVENTION

Figure 1:
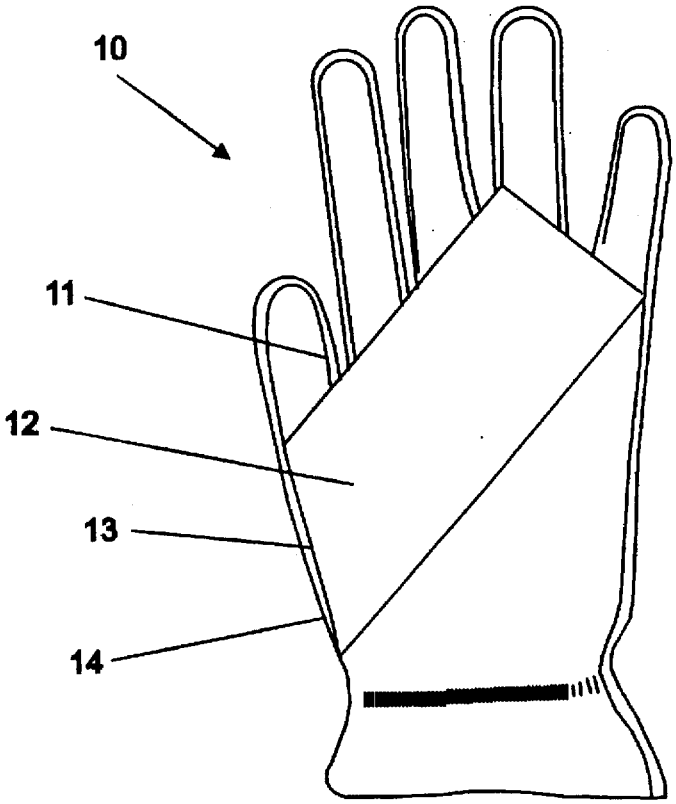
FIG. 1 PRIOR ART

As shown in FIG. 1, a golf glove 10 of the prior art includes a strap 11 sewn onto the glove and facing a diagonal direction across the glove. The strap has an end 12 having an edge 13 sewn parallel and near edge 14 of the glove transversing the palm and away from the wrist.

Figure 3:
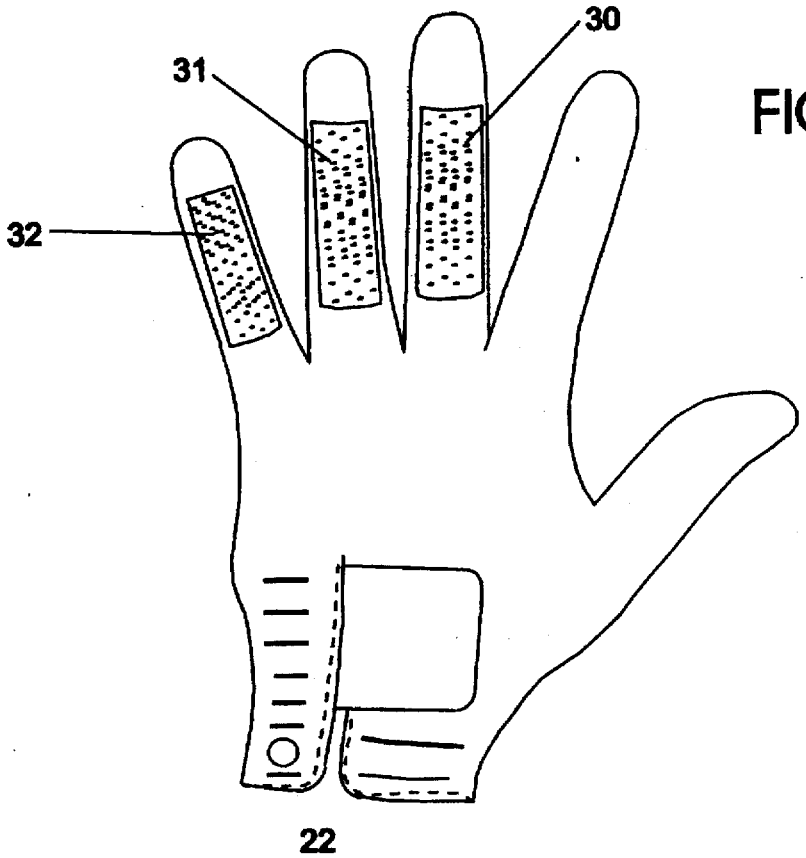
FIG. 3 is a rear view of the present invention golf glove.
Figure 2:
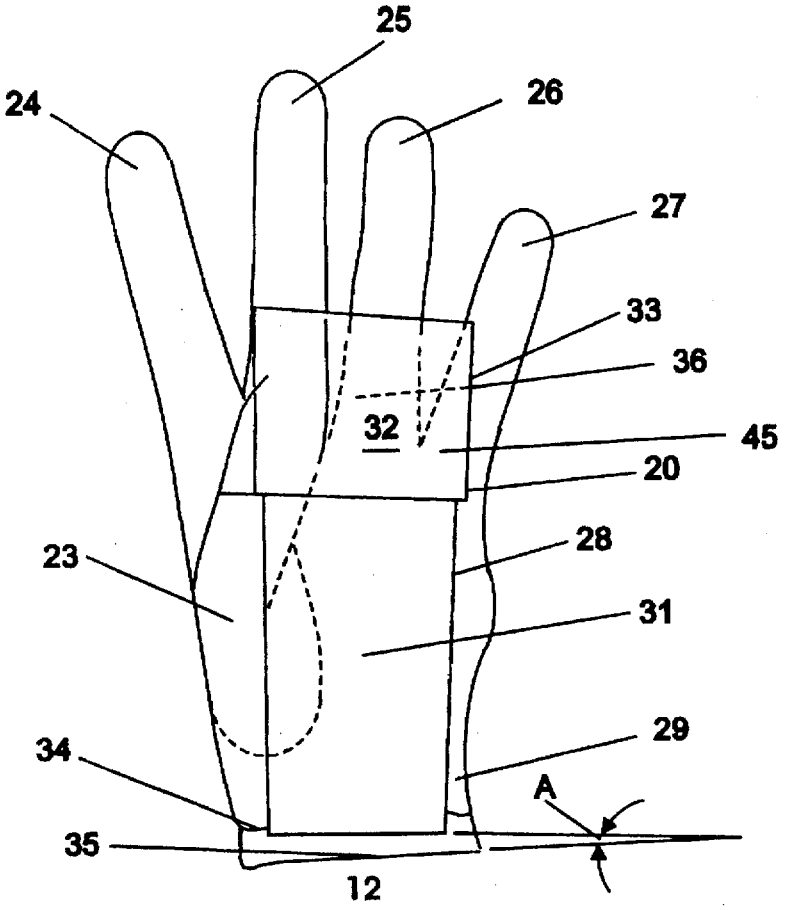
FIG. 2 is a front view of the present invention golf glove.
Figure 4:
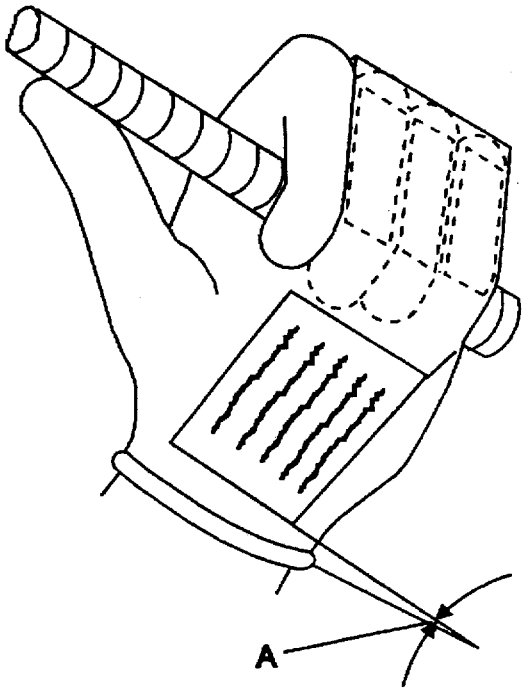
FIG. 4 is a perspective view, showing the manner in which the glove is used.

The present invention is depicted in FIGS. 2–4 and shows a golf glove 20 made of leather or of an artificial leather-like material. The glove has a front side 21 as shown in FIG. 2 and a rear side 22 as shown in FIG. 3. The sides form a thumb portion 23, an index finger portion 24, a middle finger portion 25, a ring finger portion 26, and a little finger portion 27. These portions receive the fingers of the hand of the wearer.

Turning to FIG. 2, the front side 21 has a palm area 28 and a wrist area 29 formed below the palm area 28 and the thumb area 23. There is also an area denoted 20 located under the middle, ring, and little fingers. It is here that the club grip is first placed as the club is gripped by the glove hand. Attached to the glove along a line near the lower edge of the glove and at a slight angle A to the lower edge of the glove is an elastic strap positioning means 31. This positioning means is made of stretchable material with a top side 32 and a bottom side 33. At the end of the positioning means opposite from the point of attachment to the glove is a section of "Velcro" hook and eye pile material 36 facing inwardly along the bottom side 33 of the positioning means. A covering material 45 covers a portion of the top side 32 of the positioning means. The positioning means 31 is attached at the proximal end 34 at a slight angle relative to the lower edge of the glove 35. This is shown in the drawing as angle A. This angle A is approximately parallel to the angle formed by the base of the middle finger 25, the ring finger 26, and the little finger 27 with a line parallel to the base of the wrist. Just as the size and shape of people's hands vary, the angle formed by the base of these three fingers with the base of the wrist will also vary. However, for most people this angle is approximately twenty degrees, give or take a few degrees. If a glove was being designed to custom fit an individual golfer, the angle A would be tailored so that it would be exactly the same as the angle formed by the base of the middle finger, ring finger, and little finger with the base of the wrist. It is possible to attach the elastic strap at its proximal end at the base of the glove by a means that allows individual adjustment of the angle A to provide a precise parallel relationship of the attachment angle A with the angle created by the base of the pressure fingers. This allows exact accommodation of individual differences among golfers of the angle A. Matching hook and eye pile material, known by the trade name "Velcro" at the palm side base of the glove and of the bottom side of the proximal end of positioning means 31 would allow for an adjustable attachment. However, the transitory nature of this attachment and the danger of it loosening during use are drawbacks to this manufacturing option. Further, the positioning means 31 if easily detached could be easily lost. It is believed that permanent attachment at an angle A of around 20° is the most practical manufacturing alternative. For most people an angle A of 20° is sufficiently close to the desired angle as to have no noticeable affect on the efficacy of the invention. The positioning means band of stretchable material 31 is approximately as wide as the middle finger, ring finger, and little finger when held together as they would be when gripping the club. When unstretched it extends to approximately the middle finger portion of the golf glove.

Turning to FIG. 3, which is an illustration of the back 22 of the glove. Fastening strips 30, 31, and 32 are secured to the backs of the middle finger portion, the ring finger portion, and the little finger portion of the glove. Each finger fastening strip is made of "Velcro" hook and eye pile material and is contoured to the shape of each finger portion and extends from near the base of the finger portion to an area just short of the end of each finger portion. Obviously, the positioning and size of each strip will vary from one glove size to the next.

The present invention is used to teach the proper grip of the club as shown in FIG. 4. First, the club handle is placed along the line formed by the base of the middle finger, ring finger, and little finger. The positioning means is stretched from its point of fixed attachment at the angle a along the base of the glove, so that the miniature hook and eye "Velcro" material on the under side 33 of the positioning means mates with the miniature hook and eye "Velcro" strips on the back of each finger (30, 31, and 32). It should be noted that the degree of stretching of the elastic in the positioning means is the same for each point of attachment to the miniature hook and eye "Velcro" pile material 30 on the middle finger, 31 on the ring finger, and 32 on the little finger. As can be noted from FIG. 4, both the index finger and the thumb are unaffected by the positioning means. This allows the index finger to be fully involved in an overlapping or interlocking grip with the ungloved hand. It also frees the thumb and index finger from any involvement in the grip of the club in the glove hand. This means that the larger muscles in the upper side of the arm are uninvolved in the grip, resulting in a freer cocking and uncocking of the wrist as the club is swung first back, then through the ball to the finish position. The strap is positioned parallel with the base of the three pressure fingers so that the strap exerts equal pressure on each of the three pressure fingers resulting in an even grip pressure throughout the swing, no gaps forming in the grip during the swing, and no danger of regripping of the club at the top of the back swing.

It will be appreciated by one of ordinary skill in the art that gripping and swinging a golf club is not a scientific endeavor. While there are fundamentals if observed which are more likely to lead to good results, many highly successful golfers have had swings and grips that vary dramatically from the commonly accepted fundamentals. This is part of the charm of the game. It is believed that aligning the golf club grip by means of the positioning strap of this invention parallel to the base of the pressure fingers and insuring an even grip pressure with the club gripped there between is the best way of both gripping the golf club and of using this invention. However, in keeping with the wide degree of variation that is allowed for acceptable results in a golf swing, the precise angles and measurements as recited in this specification may be varied without departing from the essential inventive concepts taught and practiced by this invention.

I claim:

1. A golf glove for assisting a golfer to grip the club properly, for placing the wrist in the maximum desirable un-cocked position as the ball is addressed, for promoting arm extension, and for maximizing the chance of returning the club face to the proper position at impact during a swing comprising:

a five-fingered golf glove; and an elastic strap; and a first means for attaching said elastic strap near a proximal palm side edge of said five-fingered golf glove so that a proximal end of said elastic strap is at an angle to a proximal palm side edge of said five-finger golf glove, and substantially parallel to a line formed by a base of a middle finger portion, ring finger portion, and little finger portion of said five-finger golf glove; and a second means for attaching a distal end of said elastic strap to a back of the middle finger portion, ring finger portion, and little finger portion of said five-fingered golf glove.

2. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 1, wherein said first means for attaching said elastic strap is a permanent attachment means.

3. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 2, wherein said elastic strap is approximately the same width as the middle finger portion, ring finger portion, and little finger portion of said five-finger golf glove and of an unstretched length that reaches to the middle finger portion of said five-finger golf glove.

4. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 1, wherein said first means for attaching said elastic strap is means for removably attaching and detaching said elastic strap.

5. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 4, wherein said elastic strap is approximately the width of the middle finger portion, ring finger portion, and little finger portion of said five-finger golf glove and of an unstretched length that reaches to the middle finger portion of said five-finger golf glove.

6. A glove for assisting a golfer to grip the club properly, for placing the wrist in the maximum desirable un-cocked position as the ball is addressed, for promoting arm extension, and for maximizing the chance of returning the club face to the proper position at impact during a swing comprising:

a five-finger golf glove; and an elastic strap attached at an angle of 20° to a base of a palm side of said five-finger golf glove and near a base of said five finger golf glove, and means for detachably attaching said elastic strap at a distal end of said elastic strap to a back of a middle finger portion, ring finger portion, and little finger portion of said five-finger golf glove, when said middle finger portion, ring finger portion, and little finger portion are wrapped around a grip of a golf club.

7. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 6, wherein said elastic strap attached at an angle of 20° is permanently attached to a base of a palm side of said five-finger golf glove.

8. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 7, wherein said elastic strap is approximately the same width as the middle finger portion, ring finger portion, and little finger portion of said five-finger golf glove and of an unstretched length that reaches to the middle finger portion of said five-finger golf glove.

9. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 6, wherein said elastic strap attached at an angle of 20° is removably attached to a base of a palm side of said five finger golf glove.

10. A glove for assisting a golfer to grip the club properly, for placing the wrist in the maximum desirable un-cocked position as the ball is addressed, for promoting arm extension, and for maximizing the chance of returning the club face to the proper position at impact during a swing as is recited in claim 9, wherein said elastic strap is approximately the same width as the middle finger portion, ring finger portion, and little finger portion of said five-finger golf glove and of an unstretched length that reaches to the middle finger portion of said five-finger golf glove.

* * * * *